US006543823B2

(12) United States Patent
Baudard

(10) Patent No.: US 6,543,823 B2
(45) Date of Patent: Apr. 8, 2003

(54) OPENABLE PANEL FOR A MOTOR VEHICLE WITH ELECTRIC LOCK CAPABLE OF DELAYED OPENING

(75) Inventor: Xavier Baudard, Paris (FR)

(73) Assignee: Valeo Securite Habitacle, Creteil (FR)

( * ) Notice: Subject to any disclaimer, the term of this patent is extended or adjusted under 35 U.S.C. 154(b) by 67 days.

(21) Appl. No.: 09/725,138

(22) Filed: Nov. 29, 2000

(65) Prior Publication Data

US 2001/0002091 A1 May 31, 2001

(30) Foreign Application Priority Data

Nov. 29, 1999 (FR) ..... 99 14966

(51) Int. Cl.[7] ..... E05C 3/06; E05C 3/16
(52) U.S. Cl. ..... 292/216; 292/201; 292/DIG. 23
(58) Field of Search ..... 292/216, 201, 292/DIG. 23

(56) References Cited

U.S. PATENT DOCUMENTS

| | | | | | |
|---|---|---|---|---|---|
| 2,174,078 | A | * | 9/1939 | Burgin | 292/332 |
| 2,961,265 | A | * | 11/1960 | Jakeman et al. | 292/216 |
| 3,233,931 | A | * | 2/1966 | Peras | 292/123 |
| 4,364,249 | A | * | 12/1982 | Kleefeldt | 70/264 |
| 5,066,054 | A | * | 11/1991 | Ingenhoven | 292/201 |
| 5,199,288 | A | * | 4/1993 | Meriläinen et al. | 70/279 |
| 5,309,745 | A | * | 5/1994 | Ursel et al. | 70/264 |
| 5,676,003 | A | * | 10/1997 | Ursel et al. | 70/472 |
| 5,681,068 | A | | 10/1997 | Kleefeldt et al. | |
| 5,901,991 | A | * | 5/1999 | Hugel et al. | 292/201 |

FOREIGN PATENT DOCUMENTS

| | | | |
|---|---|---|---|
| DE | 3500550 | A1 * | 10/1985 |
| DE | 3835265 | A1 * | 4/1990 |
| DE | 3923726 | * | 1/1991 |
| DE | 3212172 | A1 * | 11/1992 |
| EP | 0959206 | | 11/1999 |
| FR | 159238 | A1 * | 3/1985 |
| FR | 2767348 | | 2/1999 |
| GB | 2200943 | | 8/1988 |
| JP | 534076 | A1 * | 7/1992 |

* cited by examiner

*Primary Examiner*—Gary Estremsky
*Assistant Examiner*—Carlos Lugo
(74) *Attorney, Agent, or Firm*—Liniak, Berenato & White

(57) ABSTRACT

An openable panel for a motor vehicle having a lock (3) including an opening lever, an operating member mounted on the openable panel at a distance from the lock for manual operation by a user from the outside of the openable panel. A force transmission element connects the operating member to the lock opening lever. The lock can switch from a closed condition to an open condition in response to the operation of the opening lever with the aid of the operating member. The force transmission element is in two parts connected to each other by an energy storage device. An immobilizing mechanism is provide to immobilize the second part of the force transmission element when the lock is in the locked condition and to release the second part of the force transmission element in response to an unlocking command.

17 Claims, 1 Drawing Sheet

OPENABLE PANEL FOR A MOTOR VEHICLE WITH ELECTRIC LOCK CAPABLE OF DELAYED OPENING

BACKGROUND OF THE INVENTION

1. Field of the Invention

The present invention relates to an openable panel of a motor vehicle, comprising an electric lock that includes an opening lever, an operating member that is mounted on the openable panel at a distance from said lock and that can be operated manually by a user from the outside of the openable panel, and a force transmission element that connects the operating member to the lock opening lever, which lock can move from a closed condition preventing the panel from being opened to an open condition in which the panel can be opened in response to the operation of the opening lever with the aid of the operating member.

2. Description of the Related Art

In present-day motor vehicles it is sometimes impossible to unlock the lock of an openable panel, such as a door or tailgate, in which the operating member, such as a pivoting plate or lever incorporated into the handle of the door or into the tailgate, has been operated by a driver or a passenger trying to open the door or tailgate of the vehicle from the outside of said vehicle. Such a situation can, for example, arise with a vehicle fitted with central locking/unlocking of the locks on the doors and tailgate or luggage compartment of the motor vehicle, when a passenger operates the operating member built into the handle of a door or the operating member that opens the tailgate or luggage compartment, immediately before the driver has unlocked the locks using a key or a remote control.

The situation described above can also occur with vehicles fitted with a so-called "hands-free" access system whereby a remote exchange of data is set up by a wireless communication between a recognition device installed in the vehicle and an identification means carried by a user, access to the vehicle being authorized only when the recognition device has authenticated the identification means. Although this exchange of data, the authentication of the identification means, the sending of the unlocking command to the locks and the unlocking operation itself, that is the displacement of a locking/unlocking member in each lock from its locked position to its unlocked position by means of an electromechanical actuator (electric motor or electromagnet) in response to the unlocking command, takes very little time (usually less than one second), it can nevertheless happen that, if the user operates the operating member built into the handle of a door very quickly, said operating member reaches the end of its travel for actuating the lock opening lever before the electromechanical actuator has moved the locking/unlocking member of the lock to its unlocked position or just as said locking/unlocking member reaches its unlocked position. In this case the lock cannot be placed in its open condition and the door, or other openable panel of the vehicle, cannot be opened. The user must then release the operating member and operate it a second time in order to be able to open the door or other openable panel of the vehicle. To have to work the operating member twice is of course unwelcome, especially if the user is in a hurry.

SUMMARY OF THE INVENTION

The object of the present invention is therefore to provide a solution to save the user having to work twice on the operating member built into a door handle or an openable panel such as, for example, a tailgate of a motor vehicle, in order to open said door or other openable panel.

For this purpose the invention provides an openable panel of the type defined in the preamble, wherein the force transmission element is in two parts connected to each other by an energy storage device, a first part of the two parts being connected to the operating member and the second part being connected to the lock opening lever, and wherein there is an immobilizing means that immobilizes the second part of the force transmission element when the lock is in a locked condition and that releases said second part of the force transmission element in response to an unlocking command.

With such an arrangement, if the user operates the operating member so quickly that the immobilizing means releases the second part of the force transmission element in response to the unlocking command only at the moment when the operating member completes or has nearly completed its operating travel, the second part of the force transmission element remains immobilized by the immobilizing means throughout all or nearly all of the actuating travel of the operating member. During this period, the energy storage device stores energy under the action of the operating member and of the first part of the force transmission element. Then, as soon as the immobilizing member releases the second part of the force transmission element in response to the unlocking command, at about the instant when the operating member completes its actuating travel, the energy stored in the storage device is released and used to operate the lock opening lever, thereby causing the latter to switch from its closed condition to its open condition. The user can then open the openable panel of the vehicle without having to operate the operating member a second time.

In a first embodiment of the invention, the second part of the force transmission element comprises a stop, and the immobilizing means is a plate that pivots between an active position, in which it lies more or less at right angles to the direction of movement of the force transmission element and acts on said stop to immobilize the second part of the force transmission element, and a retracted position in which said plate releases the stop so that the second part of the force transmission element can operate the lock opening lever.

In a second embodiment of the present invention, the second part of the force transmission element is a rod with a groove, and the immobilizing means is a pin or a fork capable of translational movement in the direction perpendicular to the direction of movement of the force transmission element, between an active position in which the pin or fork is engaged in said groove, to immobilize the second part of the force transmission element, and a retracted position in which the pin or fork is out of said groove and releases the second part of the force transmission element so that it can operate the lock opening lever.

The lock of the openable panel according to the invention may also include, as in the prior art, a locking/unlocking member that inhibits or allows for the switching of the lock from its closed condition to its open condition depending on whether it is in a locked position or in an unlocked position, and that can be moved from its locked position to its unlocked position in response to said unlocking command.

If such a locking/unlocking member is provided, the immobilizing means, that is the plate, the pin or the fork, can be connected by another force transmission element to the locking/unlocking member. Thus, when the latter is moved from its locking position to its unlocking position in response to the unlocking command, it carries with it, via said other force transmission element, the immobilizing means, causing it to move from its active position to its retracted position in response to said unlocking command.

In an alternative embodiment of the invention, said immobilizing means, that is the plate, the pin or the fork, is connected to an electromechanical actuator which moves said immobilizing means from its active position to its retracted position in response to said unlocking command. In this form, the immobilizing means may in itself be a locking/unlocking member that inhibits or authorizes the switching of the lock from its closed condition to its open condition depending on whether it is in its active position or in its retracted position, in addition to the locking/unlocking member that may be included in the lock or as a substitute.

If the immobilizing means is a pin or fork, then, in accordance with the second embodiment of the invention, the pin or fork may comprise an enlargement engaged in an oblong slot in an elongate rectangular plate which pivots between a first position in which it acts, by means of a first longitudinal edge of its slot, on the enlargement of the pin or fork in order to keep the latter in its active position, and a second position in which said plate acts, by means of a second longitudinal edge of its slot, on the enlargement of the pin or fork, in order to keep the latter in its retracted position.

In this situation, said plate can be connected by another force transmission element to the locking/unlocking member which moves said plate from its first position to its second position when it itself is moved from its locking position to its unlocking position in response to the unlocking command.

In an alternative embodiment, said plate can be connected to an electromechanical actuator which moves this plate from its first position to its second position in response to said unlocking command.

BRIEF DESCRIPTION OF THE DRAWINGS

Other characteristics and advantages of the invention will become clearer in the course of the following description of a number of embodiments of the invention provided by way of examples with reference to the attached drawings in which.

DETAILED DESCRIPTION OF THE PREFERRED EMBODIMENTS

Figure 1:
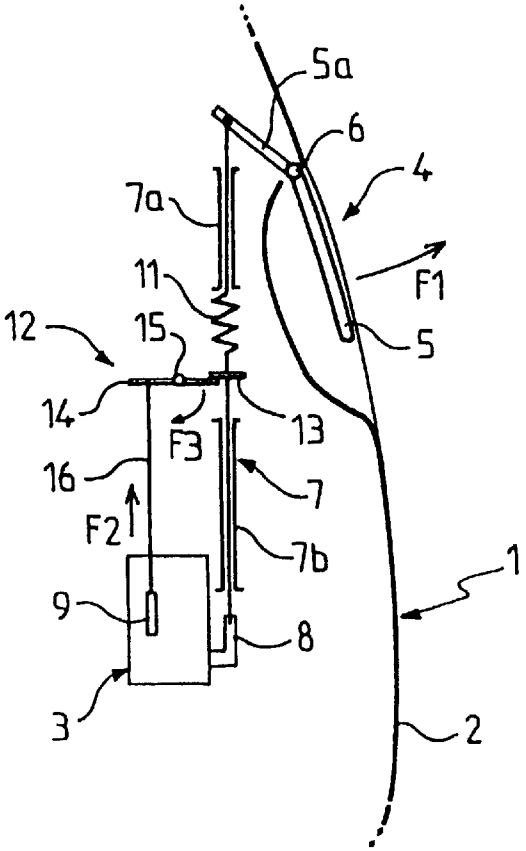
FIG. 1 is a partial and highly diagrammatic representation of an openable panel of a motor vehicle according to the invention.

Referring first of all to FIG. 1, this shows an openable panel 1, such as a door of a motor vehicle, of which only part of the outer panel 2 is shown, and that it comprises an electric lock 3 and an external door handle 4, the latter having an operating member 5, e.g. a plate rotating about a pivot 6 and connected by a force transmission element 7, e.g. a Bowden cable, to a lever 8 that opens the lock 3.

As is well known to those skilled in the art, if the lock is not locked and if a user on the outside of the vehicle acts on the plate 5 to rotate it about the pivot 6 in the direction of the arrow F1 in order to open the door 1, the plate 5 operates the lever 8, via its internal lever arm 5*a* and the force transmission element 7, to open the lock 3. More precisely, when the opening lever 8 is operated in response to the user actuating the plate 5, it moves a pawl (not shown) contained inside the lock 3 from a first position or immobilizing position in which the pawl keeps the bolt (not shown) of the lock in the locked position, to a retracted position in which the pawl releases the lock bolt, which in turn clears a strike (not shown) fixed to a fixed part of the vehicle bodywork so that the door 1 can be opened.

The lock 3 also comprises, in a known way, a locking/unlocking mechanism that includes a locking/unlocking member 9, such as a lever, that can be moved by means of an electromechanical actuator (not shown), such as an electric motor or electromagnet, from a locked position, in which it inhibits the lock from moving from its closed condition to its open condition, to an unlocked position, in which it allows the lock to move from its closed condition to its open condition, in response to an unlocking command. This unlocking command may be, for example, an electrical signal sent by a centralized locking/unlocking unit in response to the operation by a key of the lock on the driver's side of the vehicle, or in response to a signal sent by a remote-control unit such as an infrared remote control activated by a user pressing a button on the remote-control unit; or, if the vehicle is equipped with a "hands-free"-type access system, in response to a command signal sent by an electronic recognition device that has authenticated an identification means carried by an authorized user of the vehicle. When the unlocking command is sent, it may for example cause a momentary excitation of the above-mentioned electromechanical actuator, causing the locking/unlocking member to move to its unlocked position. Locking/unlocking systems are well known and, for this reason, the locking/unlocking system with which the lock 3 is equipped will not therefore be described in detail because, in addition, it is not part of the invention and the details of its construction are not necessary for the invention to be understood.

As was indicated in the preamble of this description, it may happen that the locking/unlocking member, namely the lever 9, moves to its unlocked position only at the moment when the plate 5 has completed or nearly completed its operating travel, and that the lock 3 cannot be opened. This problem can be avoided by means of the present invention by making the force transmission element 7 in two parts 7*a* and 7*b* connected to each other by an energy storage device 11 and by providing an immobilizing means 12 that immobilizes the part 7*b* of the force transmission element when the lock is in a locked condition, that is when the lever 9 is in its locked position, and that releases said part 7*b* of the force transmission element 7 in response to the unlocking command, that is when the lever 9 moves into its unlocked position.

As can be seen in FIG. 1, the part 7*a* of the force transmission element 7 may take the form of a first length of Bowden cable, one of whose ends is connected to the internal lever arm 5*a* of the plate 5 while its other end is connected to a first end of a helical spring acting as the energy storage device 11. The second end of the helical spring 11 is connected to one of the ends of a second length of Bowden cable, which acts as the part 7*b* of the force transmission element 7 and whose other end is connected to the lock 3 opening lever 8.

A stop 13 is attached to the end of the second length of Bowden cable 7*b*, which is connected to the spring 11. In the locked condition of the lock 3, this stop 13 rests on a removable or retractable stop support 14 that acts as the immobilizing means 12.

In the illustrative embodiment shown in FIG. 1, the stop support 14 is a plate able to rotate at its midpoint about a rotation pivot 15. The stop 13 rests on one of the two arms of the plate 14, the other arm of which is connected to the locking/unlocking lever 9 by a force transmission element 16, e.g. a rod or a Bowden cable.

If the lock 3 is in a locked condition as shown in FIG. 1 and if a user operates the plate 5 of the door handle 4 too quickly, that is so quickly that the lever 9 has not yet moved into its unlocked position, the plate 14 retains the stop 13 and the second length of Bowden cable 7*b*. As a result, the spring 11 is compressed by the action of the plate 5 and that of the first length of Bowden cable 7*a*. As soon as the lever 9 moves, with a certain delay, to its unlocked position in response to the unlocking command, the force transmission element 16 is displaced in the direction of the arrow F2. This causes the plate 14 to pivot out of the way, in the direction of the arrow F3, and thus release the stop 13. The mechanical energy stored in the spring 11 is now released and serves to actuate, through the second length of Bowden cable 7*b*, the lock 3 opening lever 8. The lock therefore moves into its open condition, allowing the door 1 to be opened when the user continues to apply a pulling force on the plate 5 of the door handle 4.

In the embodiment described above, with reference to FIG. 1, it has been assumed that the two parts 7*a* and 7*b* of the force transmission element 7 consisted of lengths of Bowden cable. However, at least one of the two parts 7*a* and 7*b* of the force transmission element 7 may be a rod.

Figure 3:
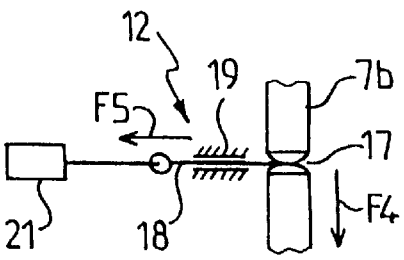
FIGS. 2, 3 and 4 show, schematically, alternative embodiments of part of the immobilizing mechanism associated with the force transmission element that serves to operate the lever that opens the lock of the openable panel shown in FIG. 1.
Figure 2:
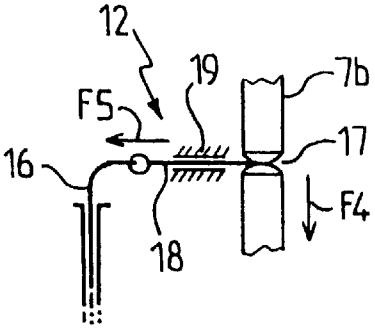
Figure 4:
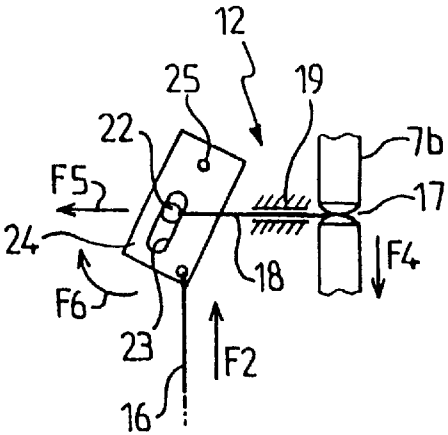

FIGS. 2, 3 and 4, show three variants in which the second part 7*b* of the force transmission element 7 is a rod. Where this is so, the rod 7*b* may incorporate a circular groove 17 and the immobilizing means 12 may be a pin 18 (or a two-pronged fork) which, when the lock is in the locked condition, is engaged in the groove 17 to immobilize the rod 7*b*. The pin 18 (or fork) is guided through an appropriate bearing 19 so that it moves at right angles to the direction of movement F4 of the rod 7*b* in response to the operation of the plate 5 of the door handle 4 or, with a certain delay, under the action of the spring 11.

In the variant shown in FIG. 2, the immobilizing pin 18 (or immobilizing fork) is connected by a force transmission element 16, such as a Bowden cable (though it could also be a control rod), to the locking/unlocking member of the lock, e.g. the lever 9 of FIG. 1. Where this is so, the force transmission element 16 is designed to pull on the pin 18 in the direction of the arrow F5 when the locking/unlocking member is moved into its unlocking position in response to the unlocking command, in order to release the rod 7*b* and thus allow the lock opening lever 8 to be operated, with or without the assistance of energy stored in the spring 11, in response to the operation of the plate 5 of the door handle 4.

In the variant shown in FIG. 3, the immobilizing pin 18 (or immobilizing fork) is connected to an electromechanical actuator 21, e.g. an electromagnet, which moves the pin 18 in the direction of the arrow F5 when energized in response to the unlocking command.

In the variant shown in FIG. 4, the immobilizing pin 18 (or immobilizing fork) carries an enlargement 22 which is engaged in an oblong slot 23 in an elongate rectangular plate 24. This plate 24 pivots about a pivot pin 25 and is connected by the force transmission element 16 to the locking/unlocking member, e.g. the lever 9 of the lock 3 in FIG. 1.

In this form, while the lock 3 is locked, one of the two longitudinal edges of the slot 23 of the plate 24 acts on the immobilizing pin 18 in order to keep it engaged in the groove 17 in the rod 7*b*, thus preventing any longitudinal movement of the latter.

However, when the lever 9 is displaced to its unlocked position in response to the unlocking command, the force transmission element 16 moves in the direction of the arrow F2, acting on the plate 24 so that it pivots in the direction of the arrow F6. When this happens, the other longitudinal edge of the slot 23 of the plate 24 acts on the enlargement 22 to displace the immobilizing pin 18 in the direction of the arrow F5, with the result that the pin moves out of the way and releases the rod 7*b* in order that the latter can actuate the lock 3 opening lever 8, with or without the assistance of energy stored in the energy storage spring 11 in response to the operation of the plate 5 of the door handle 4.

It goes without saying that the embodiments of the invention described above have been given as examples purely by way of guidance and without any restriction being intended, and that numerous modifications can easily be made by those skilled in the art without thereby departing from the scope of the invention. A particular instance is that the pivoting plate 14 of FIG. 1 or the pivoting plate 24 of FIG. 4, could be connected, not to a force transmission element such as the cable or rod 16, but to an electromechanical actuator, such as an electromagnet, that could be energized in response to the unlocking command.

What is claimed is:

1. An openable panel of a motor vehicle, comprising an electric lock (3) that includes an opening lever (8), an operating member (5) that is mounted on the openable panel (1) at a distance from said lock and that can be operated manually by a user from the outside of the openable panel, and a force transmission element (7) that connects the operating member (5) to the lock (3) opening lever (8), which lock can move from a closed condition preventing the panel from being opened to an open condition in which the panel can be opened in response to the operation of the opening lever (8) with the aid of the operating member (5), wherein the force transmission element (7) is in two parts (7*a*, 7*b*) connected to each other by an energy storage device (11), a first part (7*a*) of the two parts (7*a*, 7*b*) being connected to the operating member (5) and the second part (7*b*) being connected to the lock (3) opening lever (8), and wherein there is an immobilizing means (12) that immobilizes the second part (7*b*) of the force transmission element (7) when the lock (3) is in a locked condition and that releases said second part of the force transmission element in response to an unlocking command.

2. An openable panel as claimed in claim 1, wherein the second part (7*b*) of the force transmission element (7) comprises a stop (13), and the immobilizing means (12) is a plate (14) that pivots between an active position, in which it lies more or less at right angles to the direction of movement of the force transmission element (7) and acts on said stop (13) to immobilize the second part (7*b*) of the force transmission element (7), and a retracted position in which said plate (14) releases the stop (13) so that the second part of the force transmission element can operate the lock (3) opening lever (8).

3. An openable panel as claimed in claim 1, wherein the lock (3) also includes a locking/unlocking member (9) to selectively position the switching of the lock (3) from the closed condition to the open condition depending on whether it is in a locked position or in an unlocked position, and that can be moved from its locked position to its unlocked position in response to said unlocking command.

4. An openable panel as claimed in claim 3, wherein the immobilizing means (12) is connected by another force transmission element (16) to the locking/unlocking member (9) which moves said immobilizing means from its active position to its retracted position in response to said unlocking command.

5. An openable panel as claimed in any of claim 1, wherein the immobilizing means (12) is connected to an electromechanical actuator (21) which moves said immobilizing means from its active position to its retracted position in response to said unlocking command.

6. An openable panel as claimed in claim 3, wherein the pin (18) comprises an enlargement (22) engaged in an oblong slot (23) in an elongate rectangular plate (24) which pivots between a first position in which it acts, by means of a first longitudinal edge of its slot, on the enlargement (22) of the pin (18) or fork in order to keep the latter in its active position, and a second position in which said plate (24) acts, by means of a second longitudinal edge of its slot (23), on the enlargement (22) of the pin (18) or fork, in order to keep the latter in its retracted position.

7. An openable panel as claimed in claim 6, wherein the plate (24) is connected by another force transmission element (16) to the locking/unlocking member (9) which moves said plate from its first position to its second position in response to said unlocking command.

8. An openable panel of a motor vehicle, comprising an electric lock (3) that includes an opening lever (8), an operating member (5) that is mounted on the openable panel (1) at a distance from said lock and that can be operated manually by a user from the outside of the openable panel, and a force transmission element (7) that connects the operating member (5) to the lock (3) opening lever (8), which lock can move from a closed condition preventing the panel from being opened to an open condition in which the panel can be opened in response to the operation of the opening lever (8) with the aid of the operating member (5), wherein the force transmission element (7) is in two parts (7*a*, 7*b*) connected to each other by an energy storage device (11), a first part (7*a*) of the two parts (7*a*, 7*b*) being connected to the operating member (5) and the second part (7*a*) being connected to the lock (3) opening lever (8), and wherein there is an immobilizing means (12) that immobilizes the second part (7*b*) of the force transmission element (7) when the lock (3) is in a locked condition and that releases said second part of the force transmission element in response to an unlocking command; and wherein the second part (7*b*) of the force transmission element (7) is a rod with a groove (17), and the immobilizing means (12) is a pin (18) or a fork capable of translational movement in the direction perpendicular to the direction (F4) of movement of the force transmission element (7), between an active position in which the pin (18) or fork is engaged in said groove (17), to immobilize the second part of the force transmission element, and a retracted position in which the pin or fork is out of said groove and releases the second part of the force transmission element so that it can operate the lock (3) opening lever (8).

9. An openable panel as claimed in claim 8, wherein the lock (3) also includes a locking/unlocking member (9) to selectively position the switching of the lock (3) from the closed condition to the open condition depending on whether it is in a locked position or in an unlocked position, and that can be moved from its locked position to its unlocked position in response to said unlocking command.

10. An openable panel as claimed in claim 9, wherein the immobilizing means (12) is connected by another force transmission element (16) to the locking/unlocking member (9) which moves said immobilizing means from its active position to its retracted position in response to said unlocking command.

11. An openable panel as claimed in claim 9, wherein the immobilizing means (12) is connected to an electromechanical actuator (21) which moves said immobilizing means from its active position to its retracted position in response to said unlocking command.

12. An openable panel as claimed in claim 9, wherein the pin (18) or fork comprises an enlargement (22) engaged in an oblong slot (23) in an elongate rectangular plate (24) which pivots between a first position in which it acts, by means of a first longitudinal edge of its slot, on the enlargement (22) of the pin (18) or fork in order to keep the latter in its active position, and a second position in which said plate (24) acts, by means of a second longitudinal edge of its slot (23), on the enlargement (22) of the pin (18) or fork, in order to keep the latter in its retracted position.

13. An openable panel as claimed in claim 9, wherein the plate (24) is connected by another force transmission element (16) to the locking/unlocking member (9) which moves said plate from its first position to its second position in response to said unlocking command.

14. An openable panel of a motor vehicle, comprising an electric lock (3) that includes an opening lever (8), an operating member (5) that is mounted on the openable panel (1) at a distance from said lock and that can be operated manually by a user from the outside of the openable panel, and a force transmission element (7) that connects the operating member (5) to the lock (3) opening lever (8), which lock can move from a closed condition preventing the panel from being opened to an open condition in which the panel can be opened in response to the operation of the opening lever (8) with the aid of the operating member (5), wherein the force transmission element (7) is in two parts (7*a*, 7*b*) connected to each other by an energy storage device (11), a first part (7*a*) of the two parts (7*a*, 7*b*) being connected to the operating member (5) and the second part (7*a*) being connected to the lock (3) opening lever (8), and wherein there is an immobilizing means (12) that immobilizes the second part (7*b*) of the force transmission element (7) when the lock (3) is in a locked condition and that releases said second part of the force transmission element in response to an unlocking command;

wherein the pin (18) or fork comprises an enlargement (22) engaged in an oblong slot (23) in an elongate rectangular plate (24) which pivots between a first position in which it acts, by means of a first longitudinal edge of its slot, on the enlargement (22) of the pin (18) or fork in order to keep the latter in its active position, and a second position in which said plate (24) acts, by means of a second longitudinal edge of its slot (23), on the enlargement (22) of the pin (18) or fork, in order to keep the latter in its retracted position.

15. An openable panel as claimed in claim 14, wherein the plate (24) is connected to an electromechanical actuator which moves said plate from its first position to its second position in response to said unlocking command.

16. An openable panel of a motor vehicle, comprising:

an electric lock including an opening lever, an operating member mounted on the openable panel at a distance from said lock and that can be operated manually by a user from the outside of the openable panel, and a force transmission element connecting the operating member to the lock opening lever and transmitting a force between said operating member and said lock opening lever, the lock being able to move from a closed condition preventing the panel from being opened to an open condition in which the panel can be opened in response to the operation of the opening lever with the aid of the operating member, wherein the force transmission element includes a first part and a second part and an energy storage device disposed between said first and second part and forming a serial connection between said first and second parts to facilitate relative displacement between said first and second parts, the first part of the two parts being connected to the operating member and the second part being connected to the lock opening lever, and an immobilizing mechanism provided to immobilize the second part of the force transmission element when the lock is in a locked condition and that releases said second part of the force transmission element in response to an unlocking command.

17. The openable panel of a motor vehicle according to claim 16, wherein said energy storage device comprises a helical spring connected to each of said first and second parts of said force transmission element, said helical spring actuating said second part and displacing said second part relative to said first part to open said lock when said immoblizating mechanism releases said second part after said user initially operates said operating member.

* * * * *